United States Patent [19]

Stuttem et al.

[11] Patent Number: 5,055,829

[45] Date of Patent: Oct. 8, 1991

[54] METHOD AND APPARATUS FOR MONITORING YARN TENSION

[75] Inventors: Manfred Stuttem, Kurten; Ludger A. Deters, Remscheid, both of Fed. Rep. of Germany

[73] Assignee: Barmag AG, Remscheid, Fed. Rep. of Germany

[21] Appl. No.: 532,379

[22] Filed: Jun. 4, 1990

[30] Foreign Application Priority Data

Jan. 26, 1990 [DE] Fed. Rep. of Germany ..... 4002212
Apr. 9, 1990 [DE] Fed. Rep. of Germany ..... 4011436

[51] Int. Cl.[5] ..... G08B 21/00

[52] U.S. Cl. ..... 340/677; 19/0.22; 57/81; 66/163; 364/552

[58] Field of Search ..... 340/677; 364/552, 551.01; 66/163; 19/0.22, 0.26, 0.25; 57/81

[56] References Cited

U.S. PATENT DOCUMENTS 3,931,938 1/1976 Hasegawa et al. ..... 242/45
4,720,702 1/1988 Martens ..... 340/677
4,720,806 1/1988 Schippers et al. ..... 364/551.01

*Primary Examiner*—Glen R. Swann, III
*Attorney, Agent, or Firm*—Bell, Seltzer, Park & Gibson

[57] ABSTRACT

In monitoring the yarn tension at each of a plurality of yarn processing stations, the mean value of the monitored tension is continuously determined at each station, and the differential between the monitored value and the mean value is also continuously determined. In addition, an overall mean value is generated which is representative of an average of the mean value signals from all of the individual stations, and the overall mean value is compared with the individual mean value of each station. In the event the mean value signal at a particular station differs from the overall mean value signal by more than a predetermined tolerance limit, an alarm signal is generated.

17 Claims, 3 Drawing Sheets

METHOD AND APPARATUS FOR MONITORING YARN TENSION

BACKGROUND OF THE INVENTION

The present invention relates to a method and apparatus for monitoring the yarn tension of a continuously advancing yarn, such as at each of the operating positions of a false twist crimping machine.

U.S. Pat. No. 4,720,702 to Martens discloses a method for continuously monitoring the yarn tension at each of a plurality of yarn processing stations, and which involves continuously determining the mean value of the monitored tension at each station, and continuously determining the differential between the monitored value and the mean value. An alarm signal is generated whenever the mean value leaves a predetermined tolerance range, and also whenever the differential value leaves a second predetermined tolerance range.

In the above described method, the upper limiting value of a mean value and the lower limiting value of a mean value are set so far apart from each other for the control of the entire false twist texturing machine, as to ensure that the mean values of all working positions are within these centrally set values. Consequently, the mean value of the individual positions is able to fluctuate within a relatively wide range, which adversely affects the accuracy of the method.

It is accordingly the object of the present invention to provide a method and apparatus for monitoring the yarn tension at each of a plurality of yarn processing stations of a yarn processing machine, and wherein it is possible to respond to relatively small fluctuations of the mean value at each position.

SUMMARY OF THE INVENTION

The above and other objects and advantages of the present invention are achieved in the embodiment illustrated herein by the provision of a method and apparatus for monitoring the tension of an advancing yarn and which includes the steps of continuously monitoring the value U of the tension of the advancing yarn at each of the yarn processing stations, while continuously determining the mean value MU of the monitored tension of each of the yarns. A mean value signal SM is generated which is representative of an average of the mean value signals MU of all of the stations on the machine, and at each of the yarn processing stations on the machine, the mean value signal SM is compared with the actual mean value signal MU of the position to generate a difference signal D. An alarm signal is generated whenever the difference signal D exceeds a predetermined tolerance limit LD.

In one embodiment, the step of generating a mean value signal SM comprises continuously summing the mean value signals MU from all of said stations on said machine, and continuously dividing the sum by the number of the stations. In another embodiment, the step of generating the mean value signal SM comprises determining a desired mean value signal, and generating such signal as a constant value.

The method also preferably includes the step of continuously determining the differential DU between the monitored value and the mean value for each of the yarns, and generating a first alarm signal whenever the mean value MU for one of the advancing yarns leaves a predetermined tolerance range, or whenever the differential value for one of the advancing yarns leaves a second predetermined tolerance range.

The present method makes it possible with simple means to monitor not only the quality of the individual working stations, but also of the entire machine. This is of significance in the operation of a multi-position machine, such as a false twist crimping machine which has, for example, 216 working stations, inasmuch as the present method permits a uniform quality level to be achieved for a plurality of working stations. The mean value of the stations is determined for a plurality of working stations of the false twist crimping machine. To this end, it is possible to form the mean value of the stations from mean values which are simultaneously present, or from measured values which are simultaneously present on individual, selected stations. However, it is also possible to determine the mean value of the stations on a different machine, which serves as a pilot machine. It is further possible to determine the mean value of the stations one time based on a representative determination of a limited duration. Finally, it is possible to input the mean value of the stations by means of a continuous evaluation of the measured values or respectively mean values of individual, selected stations. Even when the mean value of the stations is not input constant in time, short-time fluctuations of the mean value are preferably filtered out, so as to limit the rate of change of the overall mean value.

The present invention provides for two basic measures, namely:

(a) An alarm signal is emitted at each position, whose continuous mean value signal MU exceeds the upper limit of a group average value USM, which remains constant during the operation or the lower limit of a group average value LSM, which remains constant during the operation. This measure allows to eliminate, i.e., discontinue the operation of positions, whose continuous mean value is considerably outside of the tolerance range LD provided for the group average value, upon the occurrence of a certain number of errors. This ensures that only those positions are operated, which are within a certain, narrow tolerance range. As aforesaid, positions outside of this tolerance range are shut down, or the packages produced thereon are assigned an inferior class of quality.

(b) An alarm signal is generated at all positions, for which a common group average value is continuously produced from the continuously measured values or continuous mean values, when the group average value leaves the tolerance range LD. In taking this measure, all positions are evaluated, for which a common group average value is determined. When the group average value of these positions leaves the tolerance range, an error signal is emitted, which leads to a lesser quality classification or even to a shutdown of the positions, when a certain number is exceeded.

(c) The upper limit UMU and the lower limit LMU for the mean value of the individual positions are not input constant, but formed after the mean value of a group of positions. In so doing, the upper limit and the lower limit follow the continuous average value of the group at a certain, predetermined interval, thus taking into account a possible scattering of the mean values of the individual positions. It is made possible to establish a quite narrow tolerance range between the upper limit UMU and the lower limit LMU. This measure is applicable in addition or as an alternative to the measures described under (a) and (b) above.

The invention will be described below with reference to diagrams and the circuit diagram of a preferred embodiment.

BRIEF DESCRIPTION OF THE DRAWINGS

Some of the objects and advantages of the present invention having been stated, others will become apparent as the description proceeds, when taken in conjunction with the accompanying drawings, in which.

DETAILED DESCRIPTION OF THE PREFERRED EMBODIMENTS

Figure 1:
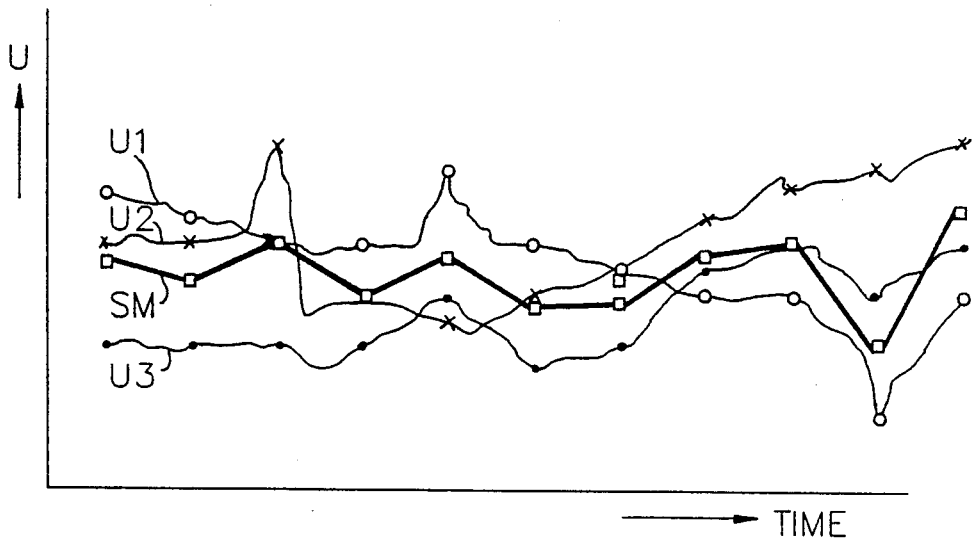
FIG. 1 is a diagram illustrating yarn tension versus time for three operating yarn processing stations.

Referring more particularly to the drawings, FIG. 1 illustrates a recording of the values measured at three working stations of a multi-position yarn processing machine. The ordinate represents the magnitude of the measured value U, and the abscissa the time. As is shown, the recording of the measured values U1, U2, U3 is different over time. In the example, the mean value SM of the positions is formed from the different measured values. This mean value of the positions may be constantly recorded for the entire machine. This means that the upper limit and the lower limit vary with the mean value of the positions, however, with the width of the tolerance range remaining constant between the upper and the lower limiting value.

It is possible to average the mean value of the positions itself over a certain evaluation time, and to form a constant mean value of the positions in this manner. In this event, the upper and the lower limiting value will also remain constant.

Likewise, it is possible to determine the mean value of the positions only on one representative machine, for example, a well adjusted machine, and to input the mean value obtained therefrom on other machines, which process the same lot. Also in this instance, it is possible to continuously record this representative mean value of the positions, or, however, to average same for a certain time and to finally input same as a constant value.

Figure 2:
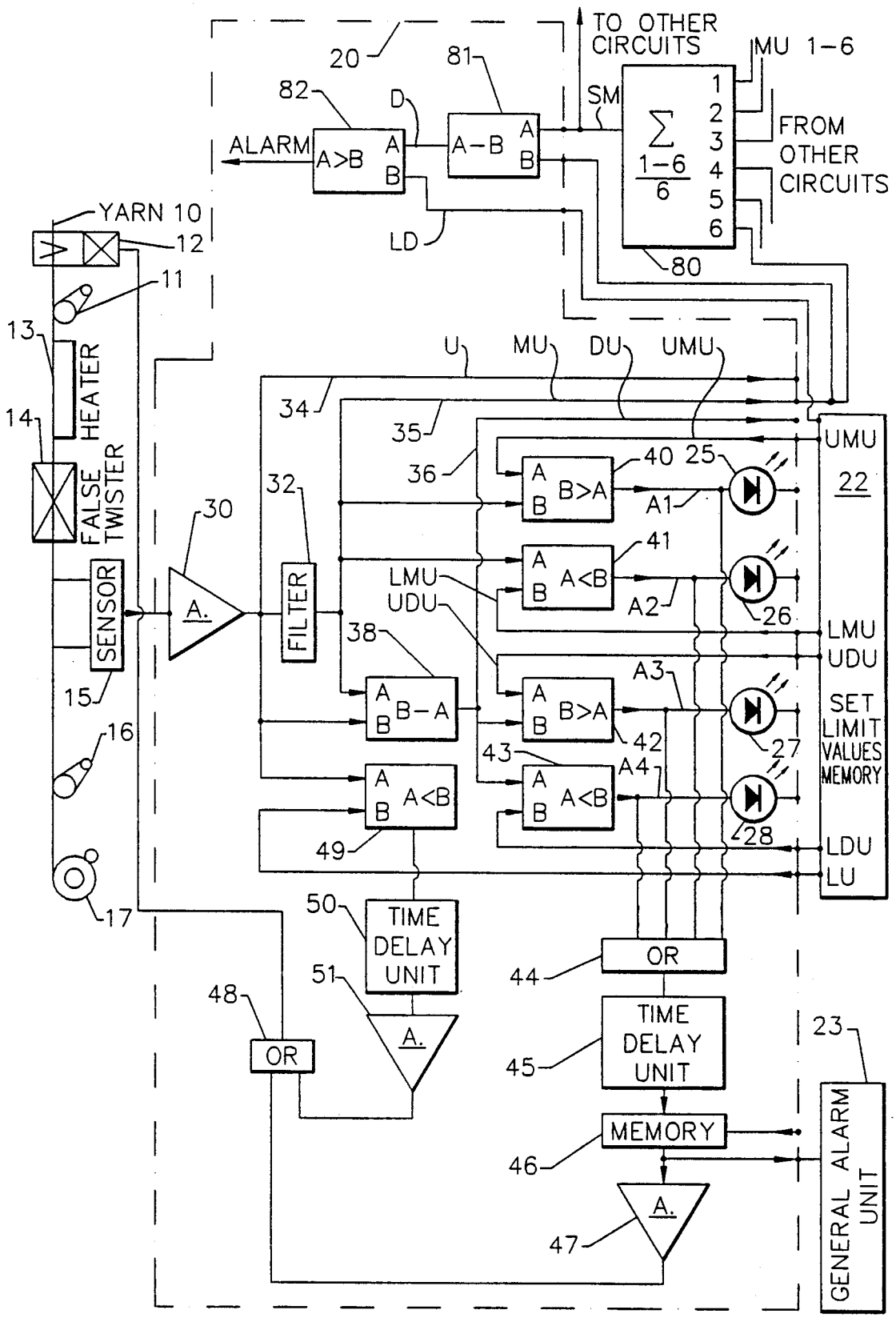
FIG. 2 is a schematic diagram illustrating an apparatus and electrical control circuit in accordance with the present invention.

FIG. 2 is a schematic diagram illustrating a yarn processing station and associated control circuitry in accordance with the present invention. The left hand portion of the diagram illustrates one yarn processing station of a multi-position false twist machine, and wherein a yarn 10 is withdrawn from a supply roll or other source (not shown) by delivery roll 11. The yarn advances past a conventional yarn cutter 12, and then it is guided across and in contact with a heater 13, through a false twister 14, and past a yarn sensor 15. The yarn is withdrawn from the false twisting zone by delivery roll 16 and wound onto a package 17 by means of a conventional winder.

The output signal U of the sensor 15 is transmitted to a circuit 20, which is illustrated within the dash-dot line of FIG. 2. Circuit 20 is associated with each position of the multi-position false twist machine, and with the yarn sensor 15 of such position. The circuit 20 receives predetermined tolerance values from a set limit value memory 22 which is described below in more detail. Memory 22 is associated with a group of stations of the multi-position texturing machine. Circuit 20 produces one output signal to the yarn cutter 12 and another output signal to a general alarm unit 23 which is also associated with a group of stations. Circuit 20, furthermore, produces output signals to alarm units 25, 26, 27, 28 which will be described below in more detail. These alarm units are correlated to the associated processing station.

The output signal of yarn sensor 15 is fed to amplifier 30 and then to filter 32. The filter is a circuit containing an induction coil and a capacitor, the circuit having a delay time constant of for example one to three seconds. The output signal of the amplifier 30 is a voltage U which may be fed to a central microprocessor for further processing and calculation via line 34. The output of filter 32 is the mean value MU which may also be fed to a general microprocessor via line 35 for further processing and calculation. On the other side, signal U and signal MU are fed to differential amplifier 38 producing an output signal DU which represents the difference of the input signals U and MU. The output signal DU of the differential amplifier 38 may be fed via line 36 to the central microprocessor for further processing and calculation.

The output signal MU of the filter 32 is furthermore used to produce alarm signals A1 and A2, if the mean value MU leaves the predetermined range of tolerance. The predetermined range of tolerance is defined by the upper limit of the mean value UMU and by the lower limit of the mean value LMU, both of which are stored in the limit value memory 22 and fed to circuit 20 via respective lines. The circuit 20 for this purpose contains triggers 40 and 41. Trigger 40 is fed by the mean value MU and the upper limit of the mean value UMU, and it is designed to produce an output signal A1, if the mean value exceeds the set upper limit of the mean value. Trigger 41 is designed to receive the mean value MU and set lower limit of the mean value LMU as an input signal and to produce an output signal A2, if the mean value Mu is lower than the set lower limit of the mean value.

The circuit 20 also produces alarm signals A3, A4, if the differential signal DU exceeds the predetermined range which is defined by a set upper limit of the differential value UDU and the set lower value of the differential value LDU. The predetermined upper and lower limits are stored in the limit value memory 22 and fed as input signals to triggers 42 and 43, respectively, of the circuit 20. The other input signal to the triggers 42 and 43 is the differential signal DU which is the output of differential amplifier 38 as described above. If the differential signal DU is greater than the set upper limit UDU, trigger 42 produces alarm signal A3. If differential value DU is smaller than the set lower limit LDU, trigger 43 produces alarm signal A4. Each of the alarm signals A1, A2, A3, A4 is fed to either one of the alarm units 25–28 which are associated with this position and which are, e.g., designed as a light emitting diode integrated into the circuit 20. Furthermore, alarm signals A1 to A4 are fed to OR gate 44, delay time unit 45, memory 46 and amplifier 47. The OR gate 44 produces an output signal, if any one of the alarm signals A1 to A4 is present. The delay time unit has a delay constant of about 10 msec, and is designed to prevent an output signal from a transient and irrelevant disturbance of the yarn texturing process, and which could result in the yarn 10 being cut by yarn cutter 12. The memory 46 ensures that a general alarm unit 23, which is associated with a group of stations or with the entire machine, will be able to generate a permanent signal to show that the production is disturbed and/or terminated.

The output signal of the memory 46 is also fed to an amplifier 47 and from there to OR gate 48, which receives another signal to be more fully described below. The output signal of the amplifier 47 produces an output signal of the OR gate 48, which in turn is fed to the yarn cutter 12 to cause cutting of the yarn and interruption of the texturizing or draw-texturizing process, as the case may be. The other input signal to OR gate 48 is produced by trigger 49 via delay time unit 50 and amplifier 51. Trigger 49 is fed by the value U representing the measured yarn tension and by a second set value LU stored in set limit value memory 22 and representing the lowest accepted value of the yarn tension. It should be noted that this value LU is preferably set at zero. Trigger 49 produces an output signal, if the measured value U is lower than or equal to the set value LU. The delay time constant of unit 50 may be about 10 msec. The output signal of trigger 49 is, as mentioned above, fed to OR gate 48 and causes yarn cutter 12 to cut the yarn upstream of delivery roll 11, if and when the yarn tension is below a set value or in case of a yarn break between delivery rolls 11 and 16.

The above described circuit generally corresponds to that disclosed in U.S. Pat. No. 4,720,702 to Martens. In accordance with the present invention, the mean values MU of a certain number of positions which all correspond to the one as shown in FIG. 2 and which all have the same circuit as shown in FIG. 2, are fed to a device 80 for summing all of the mean values, so that the sum of the mean values of these positions is determined continuously. The output signal SM of summing means 80 equals the actual sum divided by the number of positions, in this case six positions. It should be mentioned that this summing means is common to the given number of positions. At each position, however, the output signal SM of the summing means 80 is fed to a trigger 81 together with the actual mean value MU of that position. Trigger 81 forms the difference D between the overall mean value of the set number of positions and the mean value derived at the given position. This difference D is fed to another trigger 82 together with a limit difference value LD which is taken from the set limit values memory 22. Trigger 82 gives an output signal, whenever the absolute value of the difference D is greater than the absolute value of the difference limit value LD. The output signal is fed to the general alarm unit 23 or may also be used for marking the package or classifying the quality of the package as described in the patent application of Manfred Muller, Ser. No. 07/532,217, June 1, 1990, and entitled Method and Apparatus for Monitoring the Tension and Quality of an Advancing Yarn.

The difference limit value LD represents the upper limit and the lower limit of the overall mean value SM of the given number of stations in that it gives the tolerance by which the mean value MU of each station has to correspond to the overall mean value SM of all stations.

Figure 3:
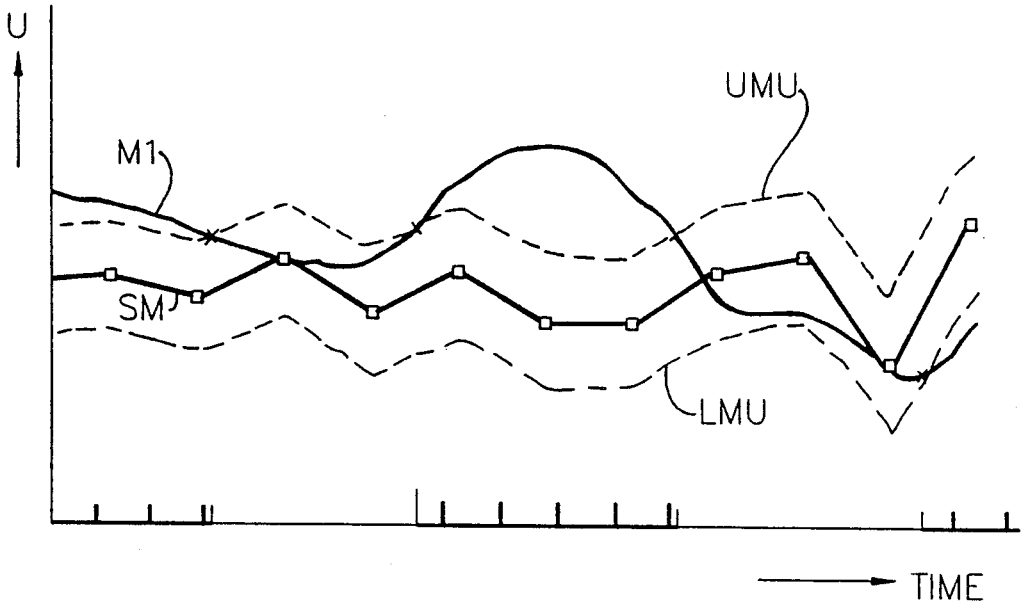
FIG. 3 is a diagram illustrating the mean yarn tension M1 of an individual station and the group average value SM versus time, and further illustrating upper and lower group average mean value limits.

The diagram of FIG. 3 shows a recording of measured values with the mean value M1 of an individual position of a group and the group average value SM, which is continuously formed from the measured values or mean values of all measuring points associated to the group. A positive interval from the mean value of the group SM and a negative interval are established. These intervals result in an upper limit line UMU or a lower limit line LMU for the mean values of all measuring points associated to the group. When now the mean value of one position, for example, M1 of a measuring point under review, leaves the tolerance range LD between the upper limit UMU and the lower limit LMU, a first alarm signal will be emitted with a time delay. This alarm signal is repeated at regular time intervals as long as the described faulty condition continues. Marked on the time axis are the faulty conditions with the individual alarm signals.

Figure 4:
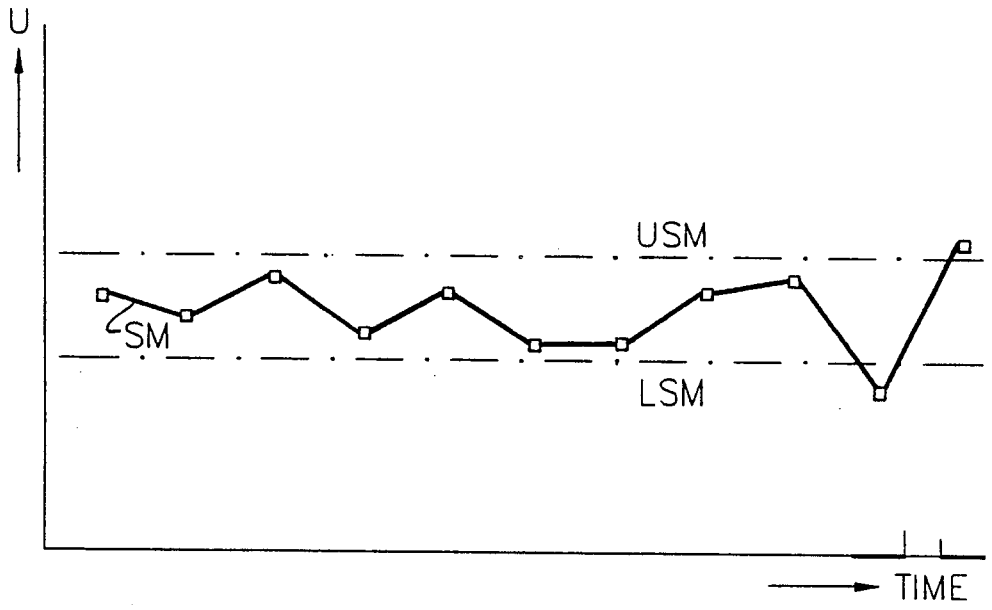
FIG. 4 is a diagram illustrating the mean value SM versus time, and further illustrating upper and lower limits thereof.

FIG. 4 represents as a diagram the portion of a recording with the mean value SM of a group of measuring points. The group average value SM is determined from the continuously measured values of the individual positions or from the continuous mean values of the individual positions. A tolerance range is established for the group average value SM between an upper limit line USM and a lower limit line LSM. An alarm signal is emitted at all positions associated to the group with a time delay, when the average value of the group leaves its tolerance range. This alarm signal is repeated at regular time intervals as long as the described faulty condition continues. The respective faulty condition is again plotted on the time axis with the emitted alarm signals.

Figure 5:
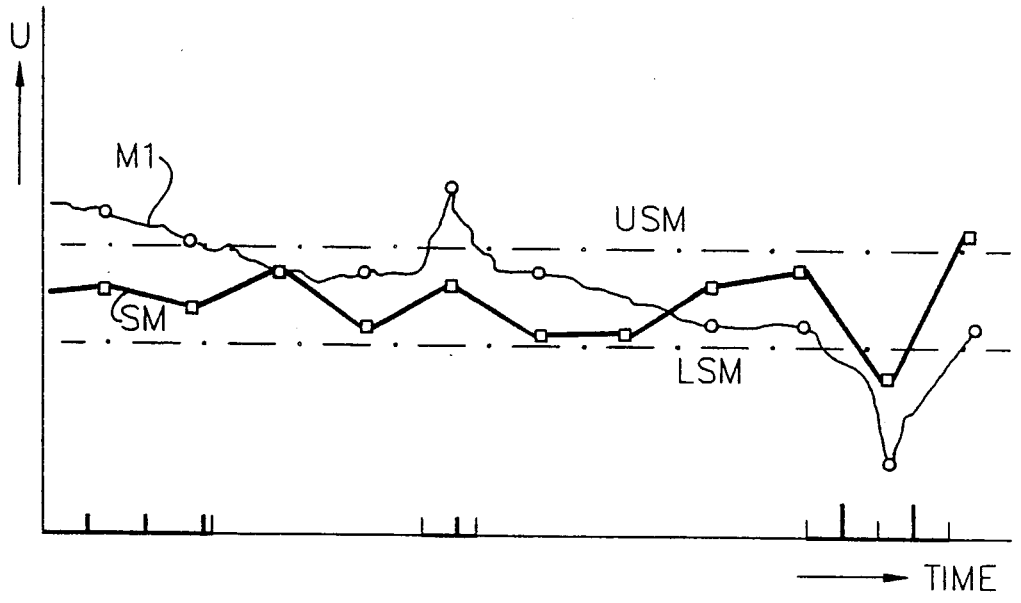
FIG. 5 is a diagram illustrating the mean yarn tension M1 of an individual station and the group average value SM versus time, and further illustrating established upper and lower limits for the mean value.

As an alternative of FIG. 3, the diagram of FIG. 5 is a recording of the mean value M1 of a certain position as well as the group average value SM of all measuring points associated to the group. Again, a tolerance range is established for the group average value with an upper limit line USM and a lower limit line LSM.

An alarm signal is emitted with a time delay at each measuring point, whose mean value, for example, M1, leaves the tolerance range of the group average value between the upper limit line USM and the lower limit line LSM. Likewise, as was described already with reference to FIG. 4, an alarm signal is emitted with a time delay at all positions associated to the group, when the mean value of the group SM leaves its tolerance range between the upper limit line USM and the lower limit line LSM. The alarm signals are each repeated at regular time intervals as long as the described faulty conditions last.

The emitted alarm signals can be only optical or acoustical signals. The alarm signals can be also used to shut down one position or a group of positions of the machine. Further, the alarm signals can be used to classify the quality of the produced yarns and packages. In this instance the number of the errors will determine the class of quality.

In the drawings and specification, there has been set forth a preferred embodiment of the invention, and although specific terms are employed, they are used in a generic and descriptive sense only and not for purposes of limitation.

That which is claimed is:

1. A method of monitoring the tension of an advancing yarn at each of a plurality of monitored yarn processing stations of a yarn processing machine comprising the steps of continuously monitoring the value (U) of the tension of the advancing yarn at each of the yarn processing stations, while continuously determining the mean value (MU) of the monitored tension of each of the yarns, generating a group mean value signal (SM) representative of an average of the mean value signals (MU) of a group of said stations, and at each of said yarn processing stations on the machine, comparing the group mean value signal (SM) with the actual mean value signal (MU) of the position to generate a difference signal (D), and generating an alarm signal whenever the difference signal (D) exceeds a predetermined tolerance limit (LD).

2. The method as defined in claim 1 wherein the step of generating a group mean value signal (SM) comprises continuously summing the mean value signals (MU) from all of said stations of the group, and continuously dividing the sum by the number of said stations.

3. The method as defined in claim 1 wherein the step of generating a group mean value signal (SM) comprises continuously summing the actual tension value signals (U) from all of the stations of the group, forming the mean value of the sum, and continuously dividing the mean value of the sum by the number of said stations.

4. The method as defined in claim 1 wherein the step of generating a group mean value signal (SM) comprises determining a desired group mean value signal, and generating such signal as a constant value.

5. A method of monitoring the tension of an advancing yarn at each of a group of monitored yarn processing stations of a yarn processing machine, comprising the steps of continuously monitoring the value (U) of the tension of the advancing yarn at each of the yarn processing stations, while continuously determining the mean value (MU) of the monitored tension of each of the yarns, generating a group mean value signal (SM) representative of an average of the mean value signals (MU) of all of said stations of said group, and generating an alarm signal at each of said yarn processing stations whenever the group mean value signal (SM) exceeds a predetermined tolerance limit (LD).

6. A method of monitoring the tension of an advancing yarn at each of a plurality of monitored yarn processing stations of a yarn processing machine, comprising the steps of continuously monitoring the value (U) of the tension of the advancing yarn at each of the yarn processing stations, while continuously determining the mean value (MU) of the monitored tension of each of the yarns, generating a group mean value signal (SM) representative of an average of the mean value signals (MU) of a group of said stations, setting a constant positive/negative tolerance limit (LD) relative to said group mean value signal to thereby define an upper limiting value (UMU) and a lower limiting value (LMU) for the mean value of each position, and at each of said yarn processing stations of the group, comparing the group mean value signal (SM) with the actual mean value signal (MU) of the position to generate a difference signal (D), and generating an alarm signal whenever the difference signal (D) exceeds said predetermined tolerance limit (LD).

7. A method of monitoring the tension of an advancing yarn at each of a plurality of monitored yarn processing stations of a yarn processing machine, comprising the steps of continuously monitoring the value (U) of the tension of the advancing yarn at each of the yarn processing stations, while continuously determining the mean value (MU) of the monitored tension of each of the yarns, and while also continuously determining the differential (DU) between the monitored value and the mean value for each of the yarns, generating a first alarm signal whenever the mean value (MU) for one of the advancing yarns leaves a predetermined tolerance range(UMU;LMU), or whenever the differential value (DU) for one of the advancing yarns leaves a second predetermined tolerance range (UDU;LDU), generating a group mean value signal (SM) representative of an average of the mean value signals (MU) of all of said stations on the machine, and at each of said yarn processing stations on the machine, comparing the group mean value signal (SM) with the actual mean value signal (MU) of the station to generate a difference signal (D), and generating a second alarm signal whenever the difference signal (D) exceeds a predetermined tolerance limit (LD).

8. The method as defined in claim 7 wherein the step of generating a group mean value signal (SM) comprises continuously summing the mean value signals (MU) from all of said stations on said machine, and continuously dividing the sum by the number of said stations.

9. The method as defined in claim 7 wherein the step of generating a group mean value signal (SM) comprises determining a desired mean value signal, and generating such signal as a constant value.

10. The method as defined in claim 7 wherein the step of generating a first alarm signal includes generating an alarm signal which is correlated to the associated yarn processing station upon the occurrence of either of the stated contingencies.

11. The method as defined in claim 7 wherein the step of generating the second alarm signal includes generating an alarm signal which is correlated to the associated yarn processing station upon the occurrence of the stated contingency.

12. The method as defined in claim 7 wherein the step of generating a first alarm signal includes severing the yarn being processed at the associated yarn processing station upon the occurrence of either of the stated contingencies.

13. The method as defined in claim 12 wherein the step of severing the yarn includes passing the first alarm signal through a time delay circuit having a predetermined time constant so as to prevent the severing of the yarn in the event of the presence of a short and irrelevant alarm signal.

14. The method as defined in claim 12 wherein the step of severing the yarn includes generating a general alarm signal which is associated with a group of yarn processing stations of the machine to indicate the yarn production at least one of the associated stations has been terminated.

15. A yarn processing machine having a plurality of stations for processing an advancing yarn, comprising sensor means at each of the yarn processing stations for continuously monitoring the value (U) of the tension of the advancing yarn, first circuit means at each of the yarn processing stations and operatively connected to said sensor means for continuously determining the mean value (MU) of the monitored tension of each of the yarns, second circuit group means for generating a mean value signal (SM) representative of an average of the mean value signals (MU) of all of said stations on the machine, and third circuit means at each of said yarn processing stations for comparing the group mean value signal (SM) with the actual mean value signal (MU) of the station to generate a difference signal (D), and for generating an alarm signal whenever the difference signal (D) exceeds a predetermined tolerance limit (LD).

16. The yarn processing machine as defined in claim 15 wherein said first circuit means further comprises means for continuously determining the differential (DU) between the monitored value (U) and the mean value (MU) for each of the yarns, and means for generating an alarm signal whenever the mean value (MU) for one of the advancing yarns leaves a predetermined tolerance range (UMU;LMU), or whenever the differential value for one of the advancing yarns leaves a second predetermined tolerance range (UDU;LDU).

17. The yarn processing machine as defined in claim 15 wherein each of said processing stations includes a false twist unit for imparting false twist to the advancing yarn, and yarn delivery means positioned downstream of said false twist unit, and wherein said sensor means is positioned between said false twist unit and said delivery means.

* * * * *

UNITED STATES PATENT AND TRADEMARK OFFICE

CERTIFICATE OF CORRECTION

PATENT NO. : 5,055,829

DATED : October 8, 1991

INVENTOR(S) : Manfred Stuttem, et al.

It is certified that error appears in the above-identified patent and that said Letters Patent is hereby corrected as shown below:

Column 4, line 65, delete "either"

Column 7, line 1, after "machine" insert --,--

Column 8, line 65, after "production at" insert --at--

Signed and Sealed this

Thirtieth Day of March, 1993

*Attest:*

STEPHEN G. KUNIN

*Attesting Officer*

*Acting Commissioner of Patents and Trademarks*